US008302214B2

(12) United States Patent
McGrath

(10) Patent No.: US 8,302,214 B2
(45) Date of Patent: Nov. 6, 2012

(54) BREAST CANCER RECOVERY GARMENT

(76) Inventor: Catherine McGrath, North Andover, MA (US)

( * ) Notice: Subject to any disclaimer, the term of this patent is extended or adjusted under 35 U.S.C. 154(b) by 0 days.

(21) Appl. No.: 12/839,709

(22) Filed: Jul. 20, 2010

(65) Prior Publication Data

US 2011/0010819 A1 Jan. 20, 2011

Related U.S. Application Data

(63) Continuation of application No. 10/880,395, filed on Jun. 29, 2004, now abandoned.

(51) Int. Cl.
*A41B 9/06* (2006.01)

(52) U.S. Cl. ..... 2/114; 2/69

(58) Field of Classification Search ..... 2/114, 96, 2/74, 104, 106; 450/1, 23, 32, 36
See application file for complete search history.

(56) References Cited

U.S. PATENT DOCUMENTS 302,901 A * 8/1884 Fenne ..... 2/114
1,092,144 A * 4/1914 Grushlaw ..... 2/90
1,489,046 A * 4/1924 Thompson ..... 2/114
1,766,272 A * 6/1930 Vallier ..... 2/114
1,998,051 A * 4/1935 Gerber ..... 2/114
2,086,925 A * 7/1937 Schwidetzky et al. ..... 604/213
2,260,168 A * 10/1941 Costanza ..... 2/76
2,661,472 A * 12/1953 Miller ..... 2/74
3,116,491 A * 1/1964 Previdi et al. ..... 2/106
3,154,789 A * 11/1964 Lewis, Jr. ..... 2/104
3,557,385 A * 1/1971 Hendrickson ..... 2/114
4,144,593 A * 3/1979 Timmons ..... 2/104
4,458,365 A * 7/1984 Wood ..... 2/104
4,570,268 A * 2/1986 Freeman ..... 2/114
4,622,699 A * 11/1986 Spriggs ..... 2/114
4,698,848 A * 10/1987 Buckley ..... 2/114
4,713,842 A * 12/1987 Patterson ..... 2/104
4,759,083 A * 7/1988 Belcher ..... 2/114
4,911,677 A * 3/1990 White ..... 450/36
5,093,932 A * 3/1992 Doyle ..... 2/114
5,097,536 A * 3/1992 Cohen ..... 2/114
5,103,504 A * 4/1992 Dordevic ..... 2/243.1
5,133,086 A * 7/1992 Truitt et al. ..... 2/114
5,142,702 A * 9/1992 Piloian ..... 2/102
5,257,956 A * 11/1993 Ewen ..... 450/1
5,440,763 A * 8/1995 Shah et al. ..... 2/114
5,454,119 A * 10/1995 Thomm ..... 2/114
5,716,344 A * 2/1998 Kiel ..... 604/174
(Continued)

*Primary Examiner* — Shelley Self
*Assistant Examiner* — Richale Quinn
(74) *Attorney, Agent, or Firm* — McCarter & English, LLP; Elizabeth A. Hanley, Esq.

(57) ABSTRACT

The breast-cancer recovery system comprises a breast cancer recovery garment, an organizational subsystem and a needs kit. The breast cancer recovery garment comprises a body portion defining an opening, positioned, configured and dimensioned to allow the performance of a breast cancer treatment procedure and a closure device suitable for closing the opening when a procedure is not being performed. The body portion of the garment defines the elongated pocket proximate the bottom edge, extending along the bottom edge and defines slits in at least one of the sleeves. The body portion of the recovery garment comprises of a warm material and/or of decorative pattern. The organizational subsystem comprises a frame configured to support a plurality of color-coded files, and marked with identification tabs which relate to breast cancer patient needs, and customized medical information. A breast cancer patient needs kit comprises a basket-like container, a canvas tote bag, a canvas tote bag with a zipper closure, or a basket and clear wrap around it, at least one drug and/or medication and at least one edible item.

13 Claims, 7 Drawing Sheets

U.S. PATENT DOCUMENTS 6,148,444 A * 11/2000 Holmes et al. ..... 2/69
6,327,712 B1 * 12/2001 Armstrong et al. ..... 2/104
6,390,885 B1 * 5/2002 Brooks ..... 450/1
6,511,467 B1 * 1/2003 Reuss ..... 604/393
6,574,800 B1 * 6/2003 Leger et al. ..... 2/114
D478,203 S * 8/2003 Wheeler-Dickson et al. . D2/720
6,647,552 B1 * 11/2003 Hogan ..... 2/114
D491,340 S * 6/2004 Gorman ..... D2/728
6,820,281 B2 * 11/2004 Mariland et al. ..... 2/115
7,010,812 B1 * 3/2006 Cho et al. ..... 2/114
7,293,295 B2 * 11/2007 King ..... 2/114
7,396,272 B1 * 7/2008 Newlen ..... 450/54
7,823,221 B2 * 11/2010 Green ..... 2/114
7,942,856 B2 * 5/2011 Lentini ..... 604/345
2003/0126668 A1 * 7/2003 Scroggins ..... 2/114
2004/0226073 A1 * 11/2004 McCullar et al. ..... 2/114
2006/0173427 A1 * 8/2006 Urbina et al. ..... 604/327

* cited by examiner

BREAST CANCER RECOVERY GARMENT

RELATED APPLICATIONS

This application is a continuation of U.S. patent application Ser. No. 10/880,395, filed Jun. 29, 2004 now abandoned. The entire content of this application is explicitly incorporated herein by reference.

STATEMENT REGARDING FEDERALLY SPONSORED RESEARCH OR DEVELOPMENT (Not applicable).

TECHNICAL FIELD OF THE INVENTION

The present invention relates to a method and system of devices for improving breast cancer patient outlook during the treatment of breast cancer with the objective of providing patient comfort and improving the likelihood of a successful treatment.

BACKGROUND OF THE INVENTION

Every year, hundreds of thousands of women are diagnosed with breast cancer. The diagnosis, indeed even the fear of a diagnosis that often follows in the wake of the discovery of a lump after breast self-examination, can often be, initially at least, devastating to the patient. These issues are of neither superficial nor passing concern. To the contrary, it has been demonstrated that patient attitudes and outlooks have a direct bearing on recovery.

Notwithstanding the above, the medical system functions in the same manner as the most mundane deliverers of goods and services. Patients are all too often queued in long lines, sometimes waiting for hours for a five or ten minute visit with the doctor, or to receive treatment. Very often, radiation treatment is dispensed in basement facilities. These facilities are usually kept relatively cool to discourage the spread of germs.

Patients are forced to wait in line wearing a flimsy low-quality garment sometimes referred to as a standard hospital garment "johnny". The garment is of simple design, comprising a front portion, a pair of sleeves, and a pair of complementary rear left and right side portions, which may be tied to each other by ribbon-like ties. Tying the ties does not close the garment well, allowing chilly breezes to cause discomfort and not remotely providing any privacy. The johnny has an appearance which is plain and drab. It is embarrassingly open in the back.

As noted above, the johnny is open and because of the flimsy material of which it is made, the johnny provides for little protection from the cold. This is particularly serious because, during the treatment and recovery from breast cancer, the patient is in a weakened state and is particularly susceptible to chills which are both uncomfortable and can affect the health.

SUMMARY OF THE INVENTION

In addition to the physical discomforts noted above, important and potentially serious psychological factors come into the picture. As soon as a woman is diagnosed with breast cancer, there is a serious danger that she feels, to a certain extent, diminished. In addition to the fear of the uncertain, the losses that may be suffered by her family, and the likelihood of physical change, the health system imposes on her a depersonalized, uncomfortable, and debasing experience.

Patients are gathered together in drab, flimsy, cold, exposing, and depersonalizing johnny uniforms. These garments, far from flattering the appearance of the wearers, make the wearers look weak and sick. The garments are also identified with people who are ill. The effect is immediate and the impact felt on all who visit the patient. Human nature being what it is, the looks most likely to be seen by the patient on the faces of visitors do nothing but have an adverse impact on the patient's spirit. This, in addition to causing pain and discomfort to the patient, cannot help but be reflected unfavorably in the prospects for the success of treatment.

In essence, the patient fearing a loss of attractiveness is put in an unattractive garment which is plain and unflattering and which portrays one in a debasing, exposed, and weak-appearing way. In addition to this, the garment is depersonalizing, being commonly used by many individuals.

The difficulties encountered by the patient in the above circumstances are compounded by serious additional chores and organizational tasks. Medications must be taken regularly. Treatment often results in sores which must be treated. Post surgical drains must be maintained. Typically bulbs, to which the drains are connected, are pinned to the pants of the patient because the johnny is too flimsy to support their weight. If the patient forgets to unpin the bulbs, removing her pants results in pulling out the drains, with attendant distress, pain and the trouble, and having to get a nurse to replace the catheter. During the postoperative period, the patient is connected to surgical drains 24 hours a day, and must sleep in a relatively restricted position. This position must correspond to the position where the drains are pinned. If the patient rolls over while sleeping, the arrangement may be disrupted.

Thus the patient is confronted with dehumanizing treatment circumstances, coupled with a record-keeping task involving insurance and other related issues, which in turn is compounded by a panoply of medicines which must be obtained and whose use only serves to remind the patient of her illness, focusing in on the collection of medicines and the source or other problems which they are treating. Moreover, many simple aids, not of a prescription nature, are unknown to many patients, as doctors may be too busy to spend time to inform patients about things that might alleviate their suffering.

In accordance with the invention, a unified system is provided to boost the morale of a woman who has been diagnosed with breast cancer or is being treated for breast cancer.

In accordance with the invention, a breast-cancer recovery system is provided and comprises a garment made of a warm material, for instance cotton, flannel, or fleece, having slits and closure devices for opening and closing the garment and a pocket inside along the bottom edge of the garment for holding surgical drains. The body portion of the garment has an opening which may be positioned, configured and dimensioned to allow the performance of a breast cancer treatment procedure, a medical examination or other medical testing. The opening of the garment runs from the neck to the bottom of the garment and is secured by non-metallic snaps, buttons, hook-and-loop material, or other closure devices. On the bottom inside of the garment is a pocket that holds and conceals surgical drains and bulbs. The material of the garment may have a decorative pattern.

The breast cancer recovery system also includes an organizational filing system comprised of a frame configured to support a plurality of files which may be color-coded and marked with identification tabs which relate to breast cancer patient needs. The organizational filing system may include customized medical information forms.

The breast cancer recovery system also includes a needs kit comprised of a bag or basket containing at least one drug and/or medication and at least one edible item. For example, the needs kit may include medicated creams, teas, seasonal foods and/or drinks. The needs kit may also include items such as cosmetics, soap, self help counseling literature, a telephone card, note cards, a movie pass, a movie rental card and/or a coffee shop coupon.

At least one item selected from the group consisting of a telephone card, a movie pass, and a coffee shop coupon is disposed in the basket-like container. The breast cancer patient needs kit further comprises movie tickets or discount, restaurant services coupons, and cosmetics, lotions and soaps. It further comprises a seasonally appropriate item, such as hot chocolate during the winter or a cold soda during the summer.

BRIEF DESCRIPTION OF THE DRAWINGS

The operation of the invention will become apparent from the following description taken in conjunction with the drawings, in which.

DETAILED DESCRIPTION OF THE BEST MODE

Figure 2:
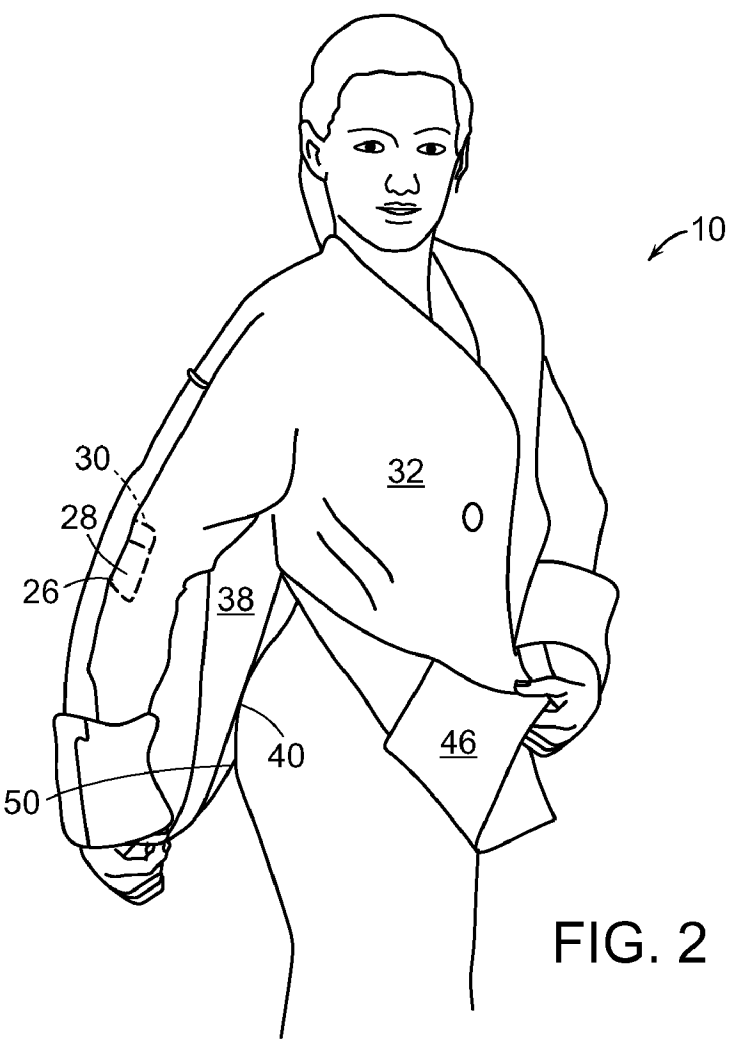
FIG. 2 is a right hand side of the garment in use with the side slit between the right hand front panel and rear panel open.
Figure 1:
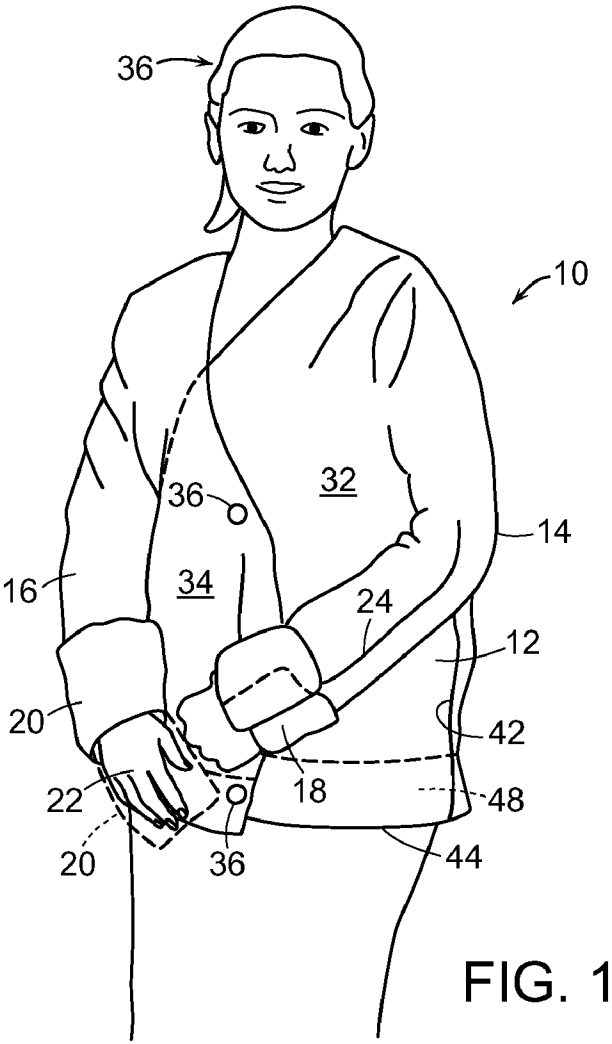
FIG. 1 is a front view of the garment in use.

Referring to FIGS. 1 and 2, in accordance with the present invention, a garment particularly adapted for the treatment of breast cancer is provided. Garment 10 comprises a body portion 12, a left arm portion 14 and a right arm portion 16.

Arm portions 14 and 16 may be provided with cuffs 18 and 20. Cuffs 18 and 20 may be unfolded down over their respective hands to the position illustrated for cuff 20 in phantom lines in FIG. 1. In this position, right hand 22 is covered by cuff 20, thus providing warmth and comfort particularly important in the weakened state of a patient receiving cancer treatment, whether it be chemotherapy, radiation therapy or surgery. If desired, hook-and-loop closures may be provided on the cuff to enhance warmth. This measure is particularly effective in view of the relatively large amount of heat which is lost by an individual through the wrists due to the proximity of the venous system to the skin.

Arm portions 14 and 16 are provided with elongated slits 24 and 26, respectively. The slits may be closed by suitable Velcro type closures, such as mating closures 28 and 30 which are hidden from view, when the garment is being worn, but illustrated in phantom lines in FIG. 2.

Elongated slits 24 and 26 are particularly useful for several procedures necessary during the course of breast cancer treatment, namely, medical examinations and testing.

Body portion 12 comprises a pair of overlapping front panels, namely left panel 32 and right panel 34. Left panel 32 and right panel 34 overlap each other over a substantial area of the front of the individual 36 wearing a garment, typically providing overlapping and almost double protection for between one third and three quarters of the area of the front of the individual wearing the garment 10. Left panel 32 and right panel 34 may be securely closed using any suitable closure, such as buttons 36, Velcro type closures and so forth.

The surface of garment 10 is completed by a rear panel 38. The garment also defines a pair of slits or openings, one opening 40 between right panel 32 and rear panel 38, and another opening 42 between left panel 34 and rear panel 38. These slits extend between 50% and 100% of the distance between the hem 44 and the armpit. This distance is generally about sixteen inches. The length of the slit is about fourteen inches, but it may range between twelve to sixteen inches in the example and it is adjusted proportionally for garments of different size.

In accordance with the preferred embodiment, three elongated pockets, namely a right pocket 46, a left pocket 48, and a rear pocket 50 are provided adjacent the hem of garment 10. Each pocket may extend the entire length of the segment of the hem adjacent to which it is positioned. In accordance with the preferred embodiment, the pockets are elongated in order to allow the placement of surgical drain bulbs at any desired position. This may be achieved both at the rear of the patient, as well as along the right or left front side of the patient, with the use of the appropriate pocket.

The pockets provide the necessary support to prevent the drains from being pulled from the body of the patient. At the same time, because they are elongated, the position of the drain collection reservoir bulbs may be easily adjusted from one side to the other, for example to accommodate sleeping in various positions and to hide the bulbs during daily routines.

The use of a pocket is particularly advantageous compared to the conventional pinning of the reservoir bulbs to the waist of the patient's pants. In the case of the conventional approach, if the patient, given the discomfort and pressure of the situation, forgets to unpin the bulbs before removing her pants, the drains are forcibly pulled from the patient.

Figure 4:
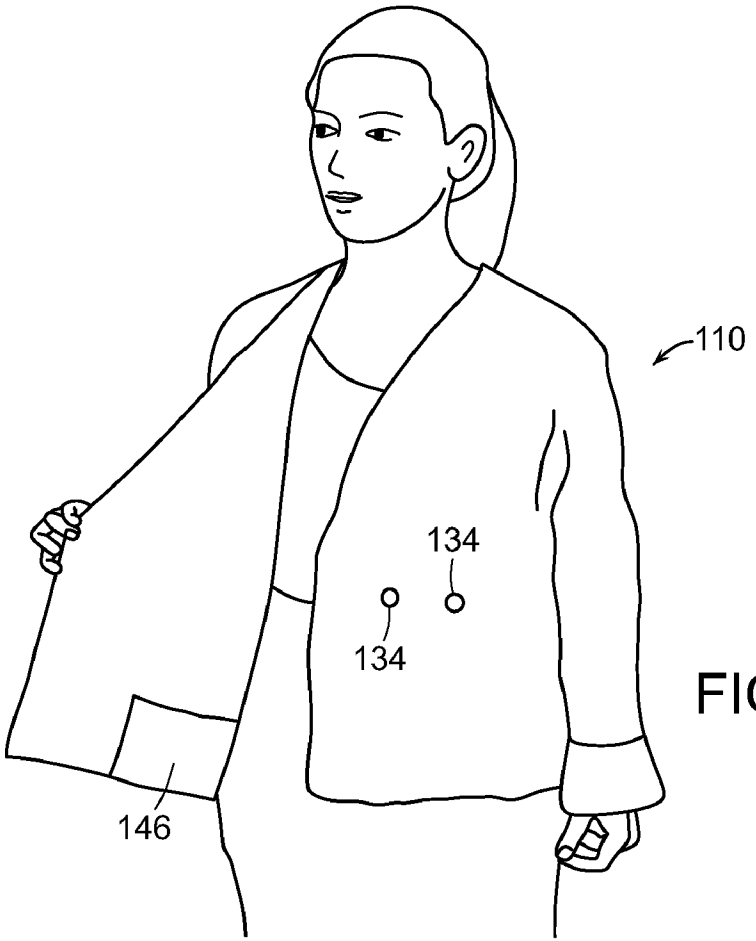
FIG. 4 illustrates yet another embodiment, in which a pair of buttons positioned parallel to the bottom edge is used to close the front of garment.
Figure 3:
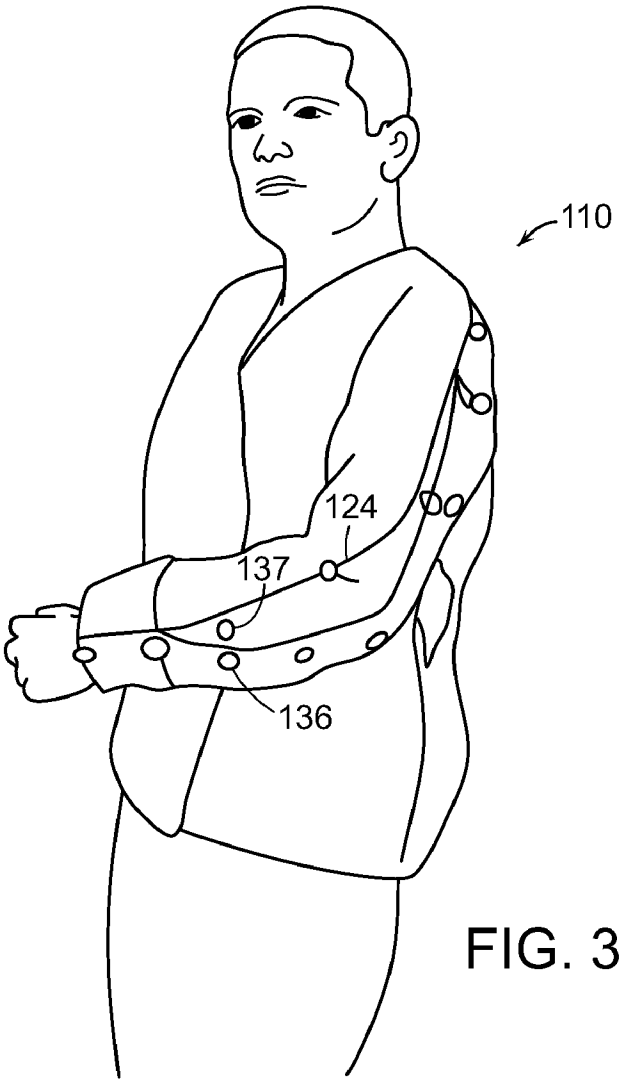
FIG. 3 illustrates an alternative embodiment, in which buttons or loops are used to close slits along the sleeves.

Referring to FIGS. 3 and 4, alternatively, buttons 136 and loops 137 may be used in a garment 110 to close slits 124. Also, if desired, a pair of buttons 134 may be used to more securely close the front of garment 110.

Alternatively, buttons 136 and loops 137 may be non-metallic snaps or hook-and-loop fasteners used in garment 110 to close slits 124.

Figure 6:
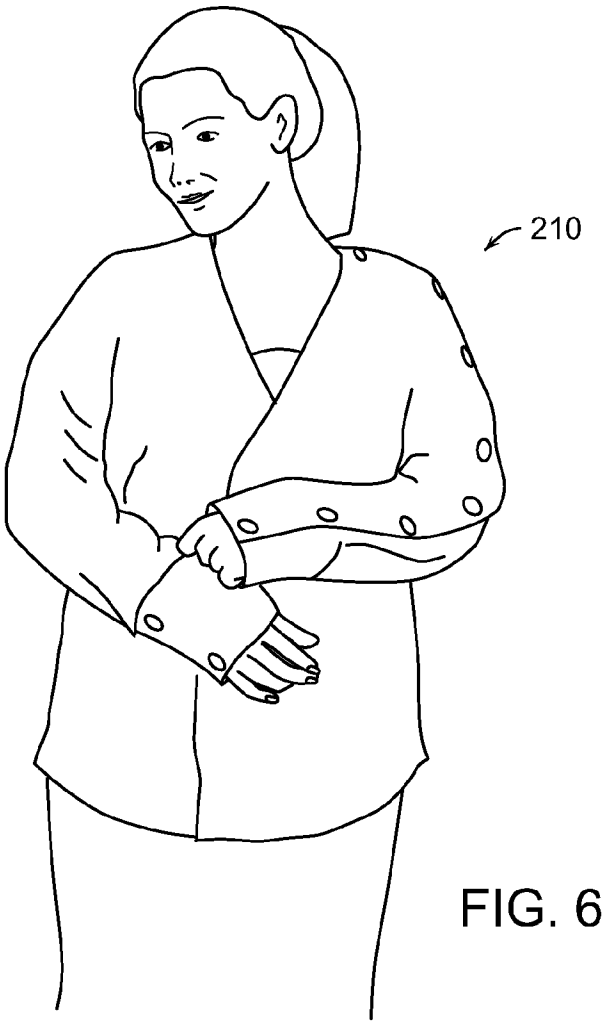
FIGS. 5-7 illustrate yet another embodiment of the invention, in which buttons along the arm and cuff are used to open and close the side of the garment.
Figure 5:
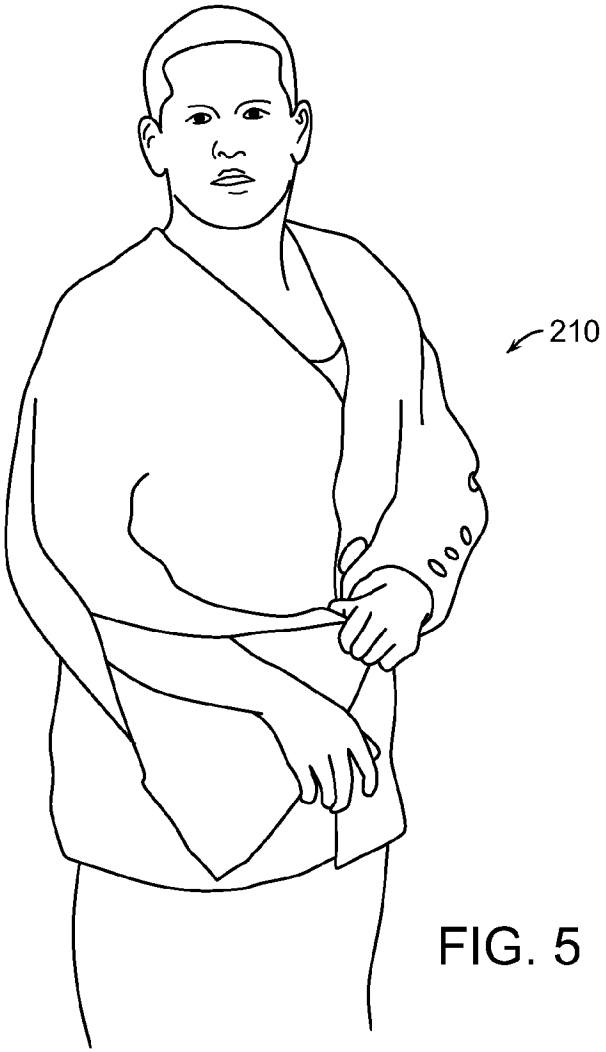
Figure 8:
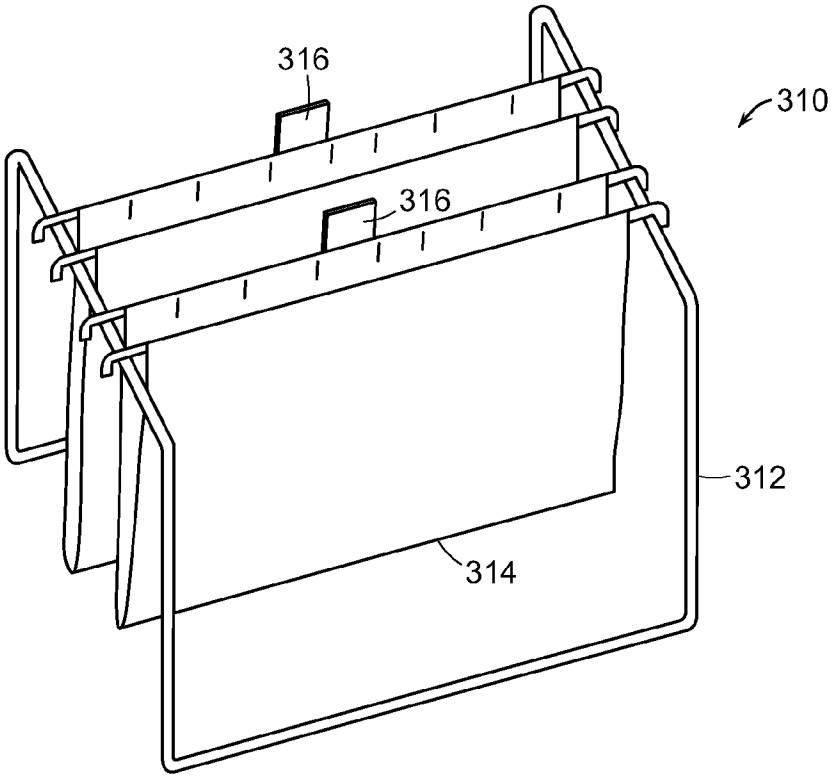
FIG. 8 is a front perspective view of the organizational filing system portion of the inventive system.
Figure 7:
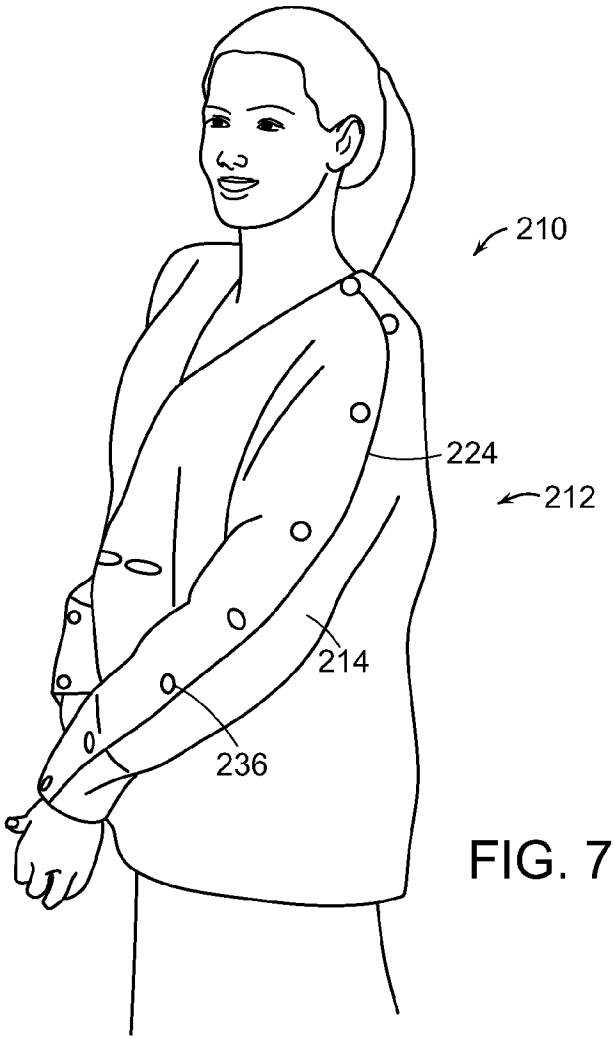

FIGS. 5-7 show yet another garment 210 constructed in accordance with the present invention. Garment 210 shows the sleeves which may be secured from top to hip during recovery and treatment, providing easy step-in access and simple access during exams while leaving a major portion of the body covered. Referring to FIG. 8, in accordance with the invention, the patient is also provided with a filing system 310 to help organize the paperwork that comes along with long breast cancer care. In connection with this, it is noted that it has been discovered, in accordance with the invention, that breast cancer patients, often because of the severe impact of the emotional stress associated with the disease, are unable to effectively cope with the problems presented by the disease in terms of organizational and financial burdens. Moreover, because of their often physically weakened and emotionally burdened state, patients are unable to organize even a simple filing system that will effectively help them to deal with the tasks associated with months of treatment.

Accordingly, in accordance with the invention, filing system 310 includes a plurality of color-coded folders, preferably each a different color. The folders are labeled with headings that allow the patient to organize the basic tasks associated with treatment.

Generally, filing system 310 comprises a frame 312 and a plurality of hanging folders 314. The hanging folders 314 have tabs 316 associated with them to identify their contents in a conventional matter. In accordance with a particularly preferred embodiment of the invention, filing system 310 is in a plastic fixed form (such as a box with a hinged cover) for easy portability. It may also be reduced in size to accommodate 8½×11 inch sheets folded in half, being six inches high and nine inches wide. Depth can vary widely, for example three, six or fifteen inches.

Filing system 310 may be designed to be sold in a collapsed form which allows it to be easily packaged with other parts of the invention system and sold as a unit.

In accordance with a particularly preferred embodiment of the invention, the filing system 310 is designed to organize medical information and to make information easily accessible to other people.

In accordance with a particularly preferred embodiment of the invention, the hanging folders 314 have tabs 316, said tabs 316 preferably identified as 1) "Patient form and questions/favorites"; 2) "Doctor's information referral form"; 3) "Your EOB insurance explanation of benefits"; 4) "Your disability and Medicare information"; 5) "Your pharmacy and Medicine information"; 6) "Your doctor's reports"; 7) "Your bills and receipts"; and 8) "Miscellaneous".

Figure 9:
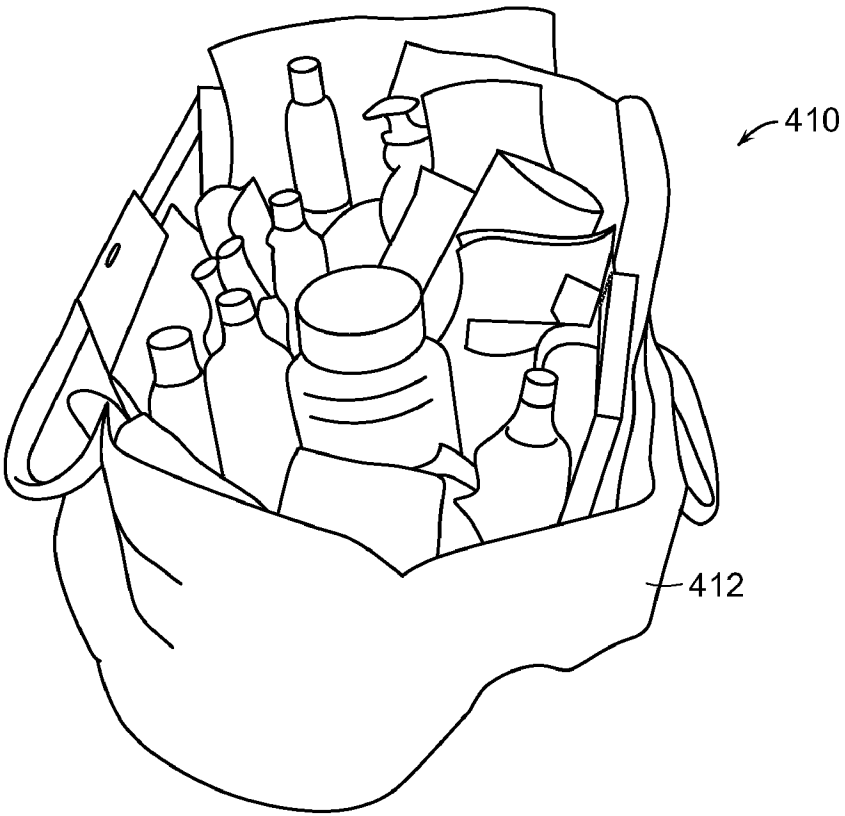
FIG. 9 is a front view of the basket-like bouquet of items portion of the inventive system.

Finally, the invention system comprises a basket-like bouquet 410 of items as illustrated in FIG. 9. The items may be included in a basket or a canvas tote 412. The items inside the canvas tote 412 are selected to meet all anticipated needs of the breast cancer patient, thus eliminating the pressure associated with thinking through one's needs and going through the trouble of acquiring numerous items from different places. In accordance with the invention, the items in canvas tote 412 include not only medications (a non-alcohol based mouth rinse, canker paste, shea butter cream, solar oil nail treatment, lavender body lotion, tea tree oil, etc.), but also treats and other pleasure giving and pressure reducing items, such as chocolates, teas, coffee beans, and the like. The basket also includes incentives to induce the individual to enter a healthier environment than solitude, such as coupons for a local coffee shop, and movie passes or movie rentals. A long-distance calling card and/or note cards helps provide the incentive for conversation with loved ones, the same being supplemented by suggestions printed on the telephone card or passes and coupons to call childhood friends and other individuals likely to reinvigorate the bedrock of a patient's social support system.

In accordance with a preferred embodiment of the invention, it is anticipated that the invention of garment 10, the filing system 310 and the bouquet 410 will be provided to the patient as a single unit. This single unit is small and compact in size and easily provided to the patient. At the same time, these three items cooperate with each other to substantially improve the breast cancer patient's circumstances.

As it is understood from the above, garment 10 is attractive, giving the patient a more attractive and less upsetting appearance to the patient herself and to others around the patient, such as her children and husband. The reaction when they see her is thus more positive instead of the grave and sad faces that follow presentation of a breast cancer patient in any typical standard hospital garment. Likewise, the patient herself feels better about herself when she looks at herself in a more positive outfit. The end result is a generally more positive outlook for all concerned.

This positive outlook is bolstered by the comfort provided by the wide array of medications and comfort foods such as chocolates, teas, coffee beans, and so forth found in the bouquet 410. Other items, such as fine jellies, cookies and hot chocolate may also be included. Improved interpersonal communication is fostered by the improved appearance of the patient and reinforced by the patient leaving home and interacting with other people at the movies, at coffee houses, and the like. Likewise, the provision of long-distance telephone cards and note cards increases contact with more people, making it more likely that the patient will have more visitors. The overall effect is a great enhancement and the sense of well-being and greater effectiveness in treatment.

Referring to FIGS. 10 through 14, in accordance with the present invention, fabric patterns that can be used to construct an embodiment of the present invention are provided.

Figure 10:
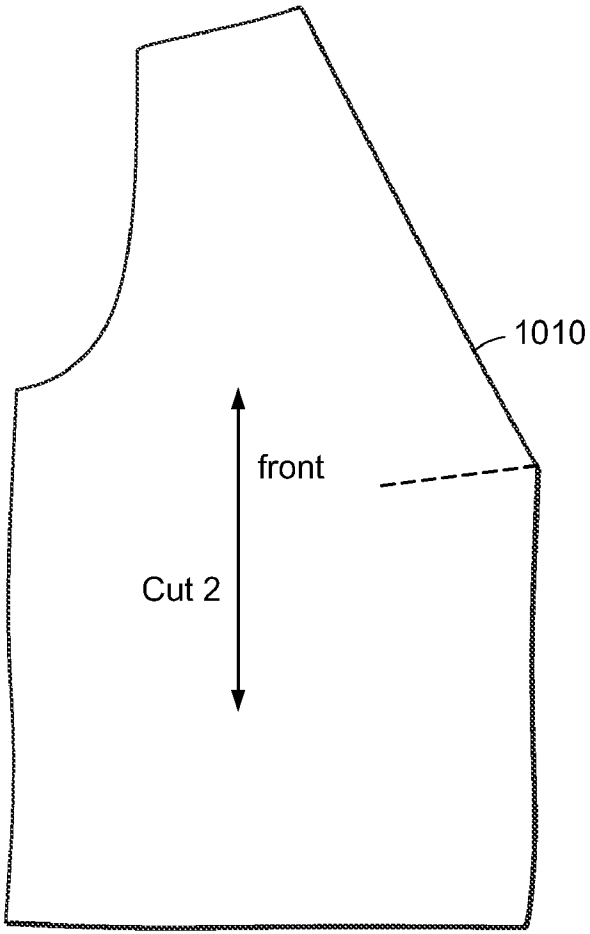
FIG. 10 is a front panel fabric pattern of one embodiment of the garment.

FIG. 10 shows front panel fabric pattern 1010, which is used to define the shape of two opposite but correspondingly-shaped pieces of fabric that are used as the front panels of one embodiment of the garment.

Figure 11:
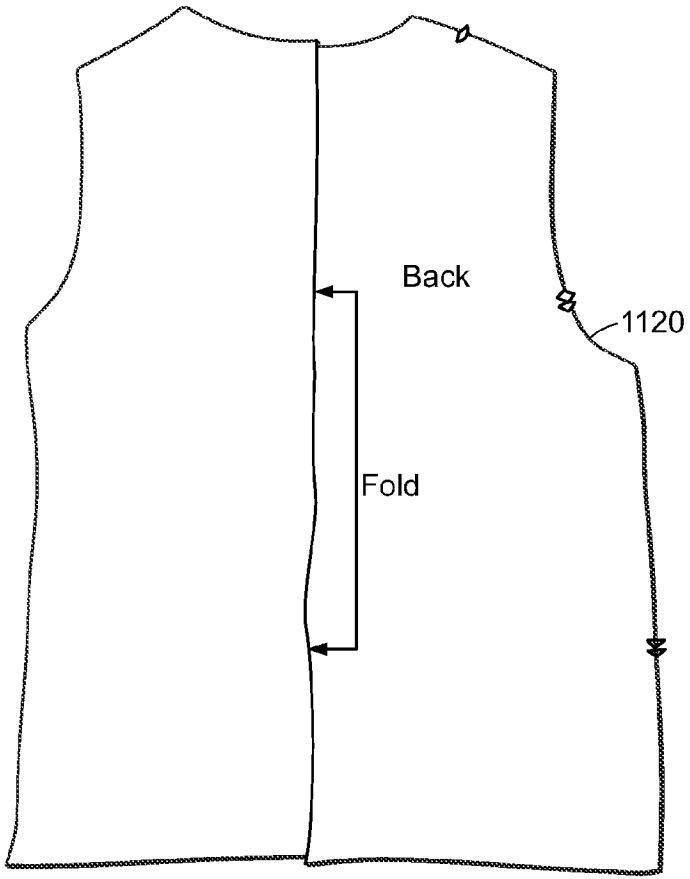
FIG. 11 is a back panel fabric pattern of one embodiment of the garment.

FIG. 11 shows the fabric pattern for back panel 1120, which is used to define the shape of the piece of fabric that is used as the back panel of one embodiment of the garment.

Figure 12:
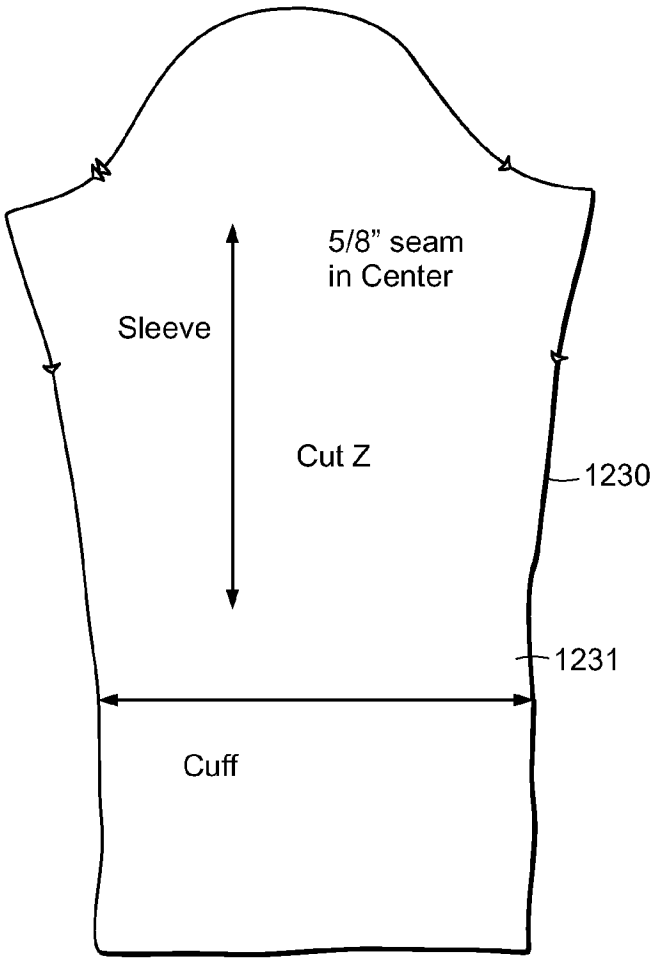
FIG. 12 is a sleeve fabric pattern of one embodiment of the garment.

FIG. 12 shows the sleeve fabric pattern 1230, used to define the shape of the piece of fabric that makes up each sleeve of one embodiment of the garment. Line 1231 denotes the position of the fold in the fabric corresponding to the cuff of the sleeve.

Figure 13:
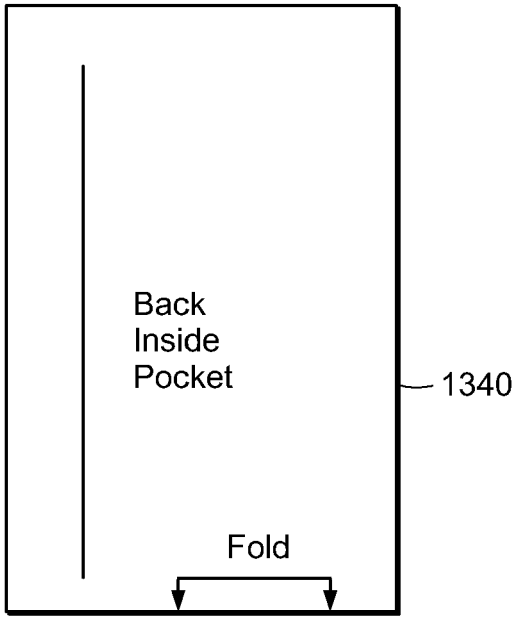
FIG. 13 is a back inside pocket pattern.

FIG. 13 shows the back inside pocket pattern 1340, used to define the shape of the piece of fabric that is sewn to the inside of the back panel at a convenient point towards the bottom of the panel.

Figure 14:
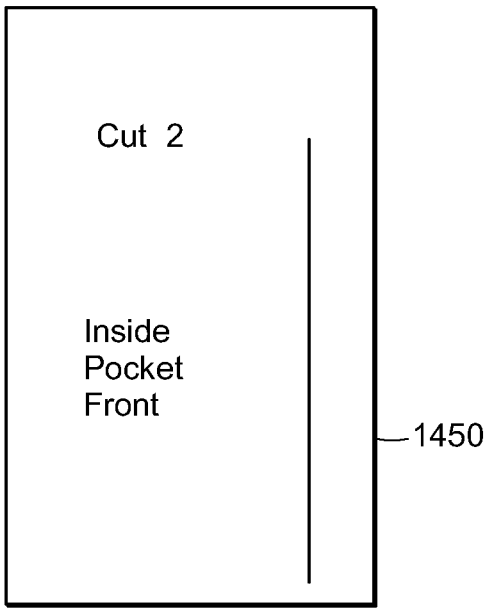
FIG. 14 is front inside pocket pattern.

FIG. 14 shows the front inside pocket pattern 1450, used to define the shape of the piece of fabric that is sewn to the inside of each of the front panels at a convenient part towards the bottom of each panel.

While an illustrative embodiment of the invention has been described, it is understood that various modifications will be obvious to those on ordinary skill in the art. Such modifications are within the spirit and scope of the invention which is limited and defined only by the appended claims.

The invention claimed is:

1. A breast cancer recovery garment, comprising:

(i) A body portion defining an opening positioned, configured and dimensioned to allow the performance of a breast cancer treatment procedure, said body portion defining a neck receiving opening at one end, and a bottom edge at the other end;

(ii) Said body portion further comprising a pair of sleeves;

(iii) At least one closure device suitable for closing said opening when a procedure is not being performed;

(iv)At least three interior pockets located proximate to said bottom edge and extending along said bottom edge positioned and providing the necessary support to prevent drains from being pulled from the body of the patient, Said body portion further comprising, a left front panel and a right front panel, and a back panel, located between the left front panel and the right front panel, wherein said front panels overlap each other such that between one third and three fourths of the front area of the panels overlap, wherein the bottom edge of the body portion is located proximate the hips of the user, and Said body portion defining a pair of slits, extending from said bottom edge, one slit between said right front panel and said rear panel, and said second slit between said left front panel and said rear panel, said pair of slits extend between 50%-100% of the distance between said bottom edge and an armpit, and Wherein each of said right front panel, left front panel and back panels comprise at least one of said at least three pockets and said at least three pockets extend the length of the panel at the bottom edge.

2. A breast cancer recovery garment as in claim 1, wherein said body portion further defines a slit in at least one sleeve beginning at said neck receiving opening and ending at the bottom edge of each sleeve.

3. A breast cancer recovery garment as in claim 2, wherein said body portion defines slits in both of said sleeves.

4. A breast cancer recovery garment as in claim 1, further comprising a cuff at the end of each of said sleeves wherein said cuffs can be unfolded to increase the length of said sleeves.

5. A breast cancer recovery garment as in claim 1, wherein said body portion is comprised of a warm material.

6. A breast cancer recovery garment as in claim 1 wherein said closure device is a non-metallic device suitable for closing said opening of the garment.

7. A breast cancer recovery garment as in claim 6, wherein said closure devices comprise non-metallic snaps.

8. A breast cancer recovery garment as in claim 6, wherein said closure devices comprise non-metallic buttons.

9. A breast cancer recovery garment as in claim 6, wherein said closure devices comprise non-metallic hooks and loops.

10. A breast cancer recovery garment as in claim 6, wherein said closure devices comprise hook and loop-type closures.

11. A breast cancer recovery garment as in claim 1, wherein said body portion is comprised of cotton or flannel.

12. A breast cancer recovery garment as in claim 1, wherein said body portion is comprised of fleece.

13. A breast cancer recovery garment as in claim 1, wherein the interior pockets are elongated.

* * * * *